United States Patent [19]

Donahue et al.

[11] 3,971,182

[45] July 27, 1976

[54] PORTABLE WALL ASSEMBLY

[75] Inventors: Charles R. Donahue; Philip J. Williams, both of Youngstown, Ohio

[73] Assignee: GF Business Equipment, Inc., Youngstown, Ohio

[22] Filed: May 2, 1975

[21] Appl. No.: 574,023

[52] U.S. Cl. ..... 52/282; 52/239; 52/498; 52/758 C; 160/135

[51] Int. Cl.[2] ..... A47G 5/00; E04B 2/82; E04F 13/08

[58] Field of Search ..... 403/227, 316, 353; 160/135, 351; 52/70, 127, 238, 239, 242, 281, 282, 495, 498, 758 C

[56] References Cited

UNITED STATES PATENTS

| | | | |
|---|---|---|---|
| 1,879,429 | 9/1932 | Noelting | 403/227 |
| 3,013,643 | 12/1961 | Perry | 403/227 |
| 3,370,389 | 2/1968 | Macaluso | 52/282 |
| 3,559,352 | 2/1971 | Magnuson | 52/239 |
| 3,762,116 | 10/1973 | Anderson | 52/282 |
| 3,766,692 | 10/1973 | Stark | 52/239 |
| 3,877,191 | 4/1975 | Munsey | 52/239 |

*Primary Examiner*—Ernest R. Purser
*Assistant Examiner*—William Randolph
*Attorney, Agent, or Firm*—Emory L. Groff, Jr.

[57] ABSTRACT

A portable wall assembly includes a plurality of panel members having vertical lateral edges releasably attachable to either square or round supporting posts by means of hook-type mounting clips projecting from the upper and lower portions of each panel vertical edge and insertable within the interior of the supporting posts prior to the actuation of a connector plug in the top thereof which is manipulated to produce expansion of the plug in a manner causing a rigid locking of the panels to the adjacent supporting posts.

12 Claims, 11 Drawing Figures

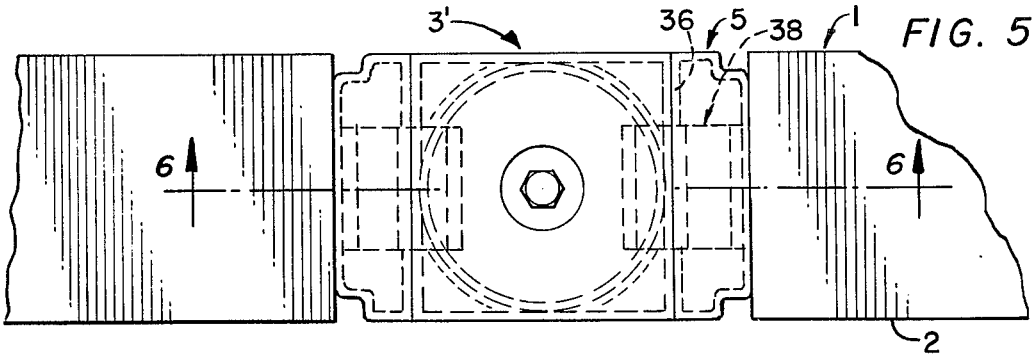
FIG. 5
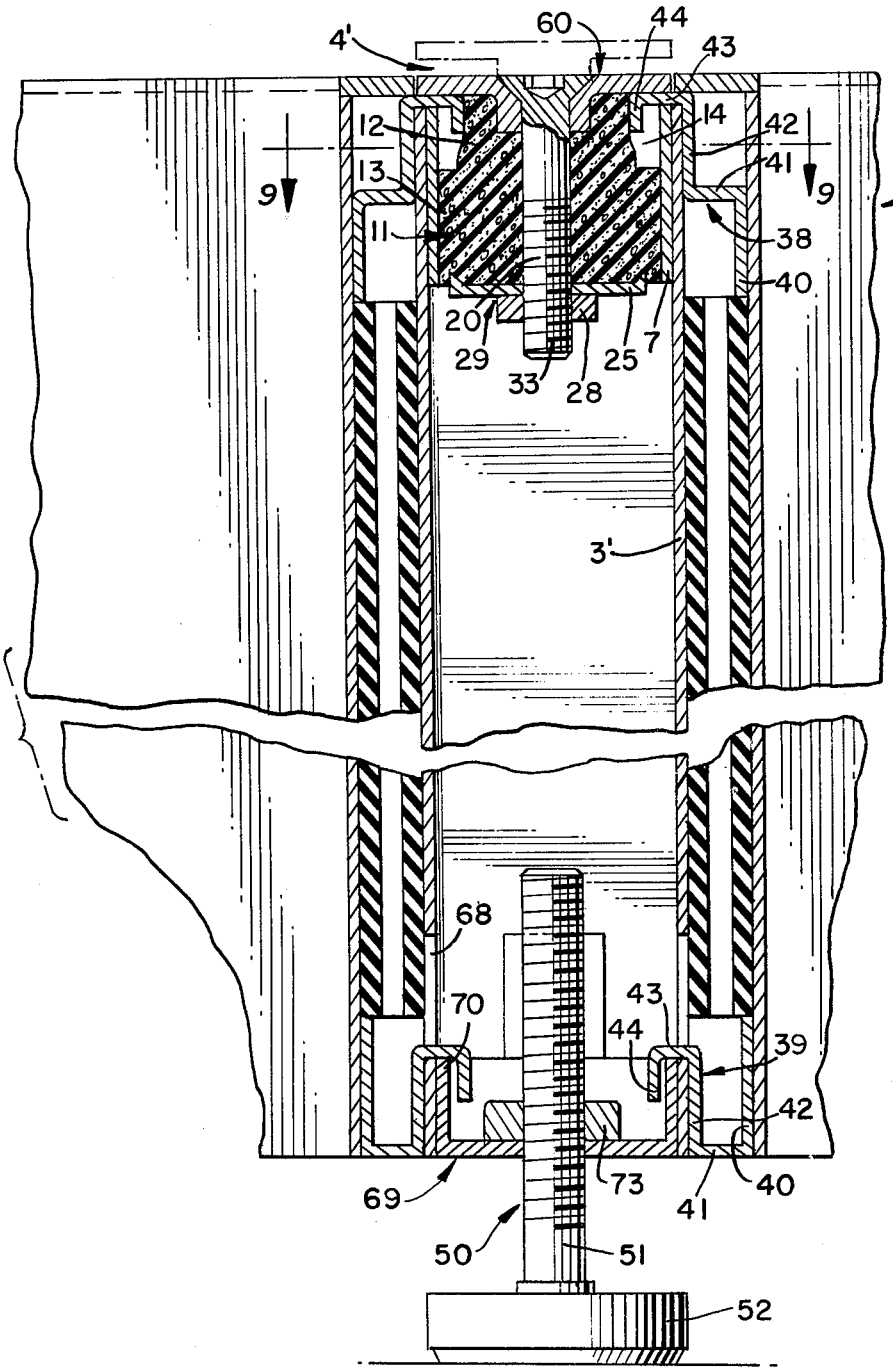
FIG. 6.
FIG. 7.
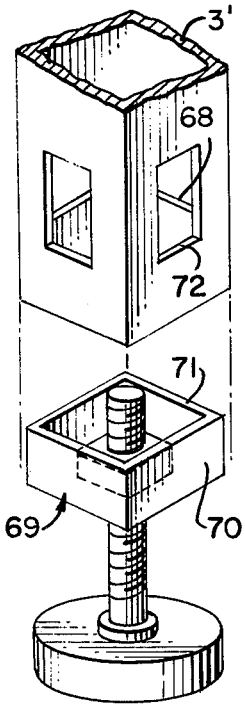

PORTABLE WALL ASSEMBLY

This invention relates generally to portable wall assemblies such as employed in providing office partition systems, and more particularly, to a wall assembly comprising a plurality of partition or screen panel members having unique means to provide a connection between the edges of the panels and adjacent vertical supporting posts with the inclusion of a unique expansible connector plug intended to retain the assembled components in a thoroughly secure relationship.

Adjustably assembled partition elements are generally well-known; however, several shortcomings have been found when utilizing certain of the presently available devices. Many of the known assemblies utilize a multitude of intricate components, leading to a prohibitive manufacturing cost factor as well as an excessive labor expense during the final assembly thereof. Other known systems require the initial sub-assembly of various components at the site of ultimate use and fail to produce a rattle-free assembly or one which provides complete screening from one side of the assembly to the other side in the area of the juxtaposed edges of the panels and periphery of the supporting posts.

By the present arrangement, an extremely simple construction is provided wherein a central mounting post or standard serves as the connecting means for joining together two, three or four panel members of similar construction into a rigid assembly. The concept of the present invention will be seen to be applicable both when utilizing a mounting post of circular or square cross section. In the case of a circular supporting post, it will be appreciated that the angular disposition between the plurality of panels which are connected to any one supporting post may be varied between 90° and 180° from one another, while in the case of a square mounting post any one or more of the four sides thereof may serve to support a corresponding number of panel members to provide either a straight line partition assembly or a right angular partition assembly or a combination of the foregoing.

An example of a wall assembly of the general type as proposed herein will be found in U.S. Pat. No. 3,766,692 issued Oct. 23, 1973, to the assignee of the instant invention. In the referenced earlier construction the assembled panels and supporting posts are secured to one another by means of a rigid top cap or connector element as opposed to the present construction wherein a novel expansible connector plug is utilized and produces a more positive unilateral clamping action between the assembled wall system components.

In the present invention, both the initial assembly of a plurality of panel elements as well as any subsequent readjustment thereof, may be readily obtained without the use of any special tools. Regardless of whether the panels are disposed in a straight line arrangement or connected together to provide an angular disposition therebetween, complete privacy may be further assured by means of the alternate inclusion of an automatically operable flexible sealing element associated with the vertical edges of each panel member.

Accordingly, one of the primary objects of the present invention is to provide an improved wall assembly including a plurality of partition or screen panel members, at least two of which members are connected by means of a common standard element to permit various selected angular positioning therebetween.

Another object of the present invention is to provide an improved wall assembly including a plurality of panel members, each of which is provided with a pair of offset mounting clips at the upper and lower portions of at least one vertical edge thereof for adjustably connecting the panels to a cylindrical standard element including a removable connector plug for retaining the assembled panel elements in their selected positions with respect to the standard member.

Another object of the present invention is to provide an improved wall assembly including a plurality of panel elements each of which is provided with a pair of offset mounting clips at the upper and lower portion of at least one vertical edge thereof for adjustably attaching the panel to a square sectioned standard element having a removable connector plug for rigidly securing the panel mounting clips to the supporting element.

Still another object of the present invention is to provide an improved wall assembly including an expansible connector plug adapted to cooperate with either a circular or square sectioned mounting post to rigidly retain one or more panel elements in fixed relationship against the periphery of the supporting posts.

With these and other objects in view, which will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which:

FIG. 5 is a fragmentary top plan view similar to FIG. 1 but illustrates the invention as applied to a square sectioned supporting post.

FIG. 6 is a partial vertical sectional view taken along the line 6—6 of FIG. 5.

FIG. 7 is an exploded partial perspective view illustrating the lower portion of the supporting post as utilized in the embodiment of FIGS. 5 and 6.

Similar reference characters designate corresponding parts throughout the several figures of the drawings.

Figure 3:
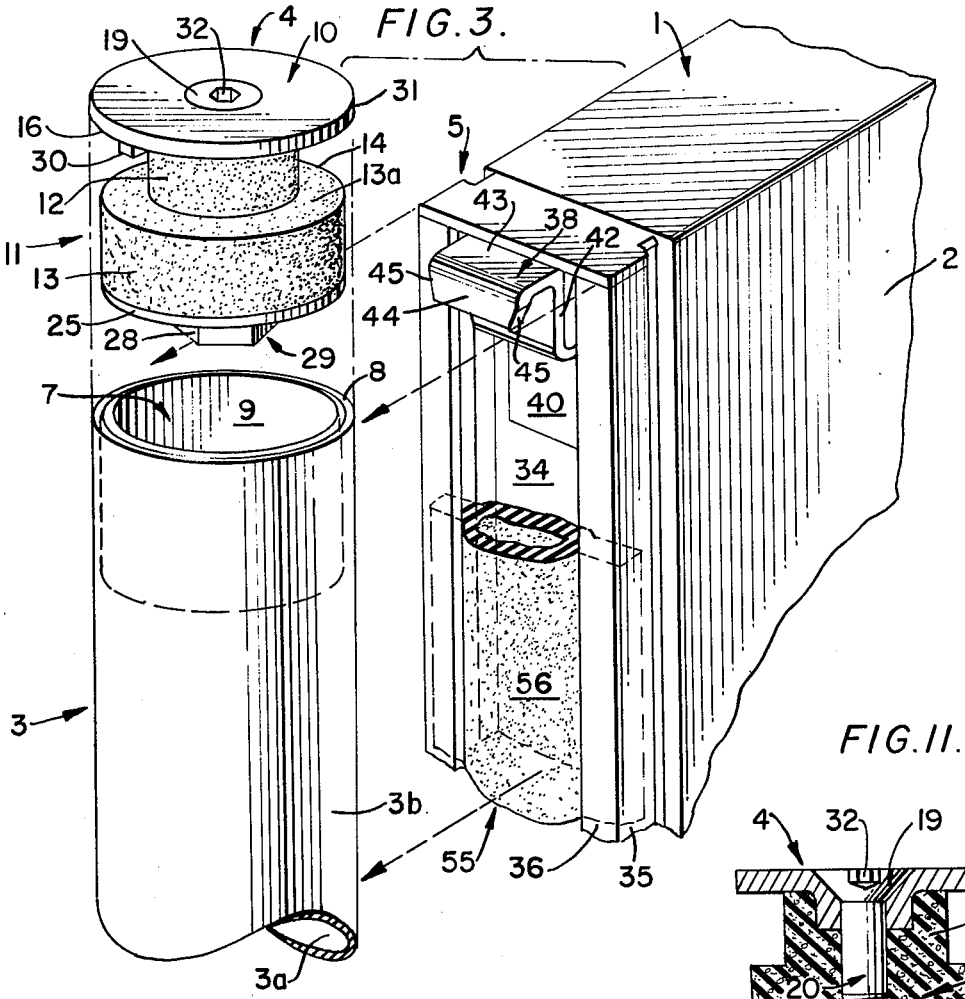
FIG. 3 is a fragmentary perspective view and illustrates the various components comprising the assembly of the invention in an exploded relationship.
Figure 8:
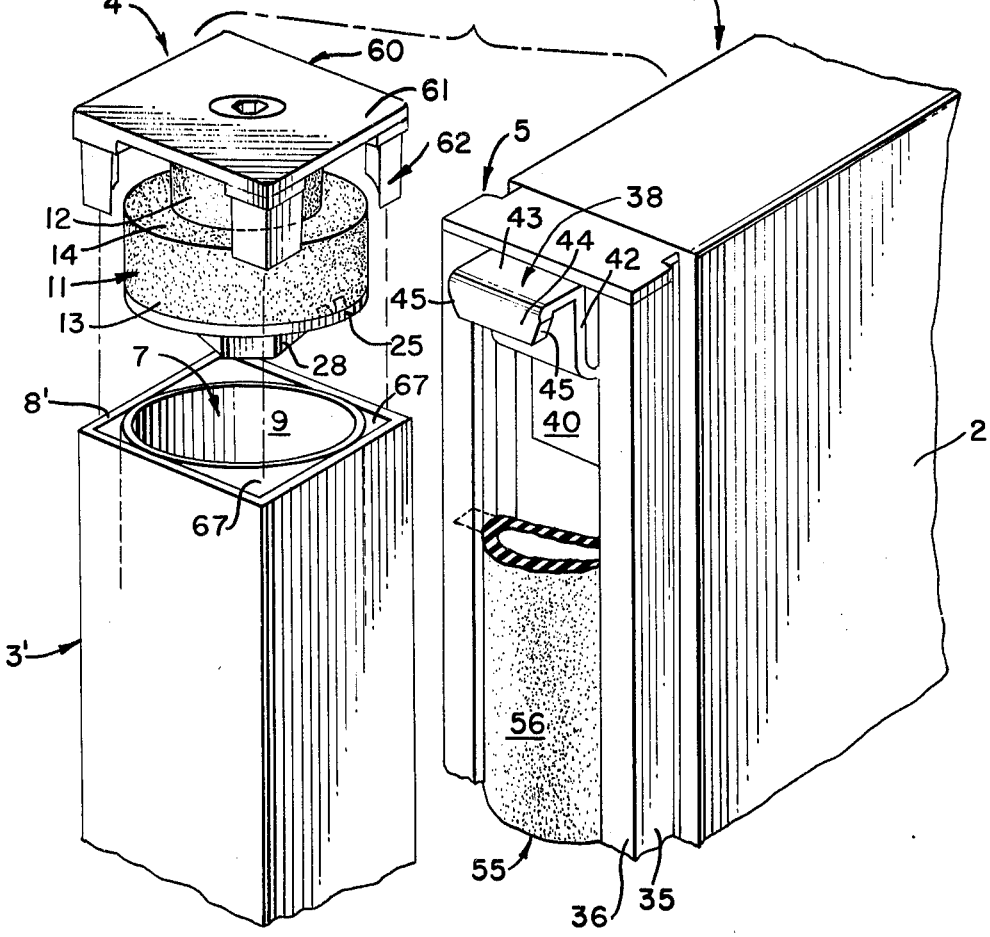
FIG. 8 is an exploded perspective view similar to that shown in FIG. 3 and illustrates the relationship of the various components in the embodiment employing a square sectioned supporting post.
Figure 9:
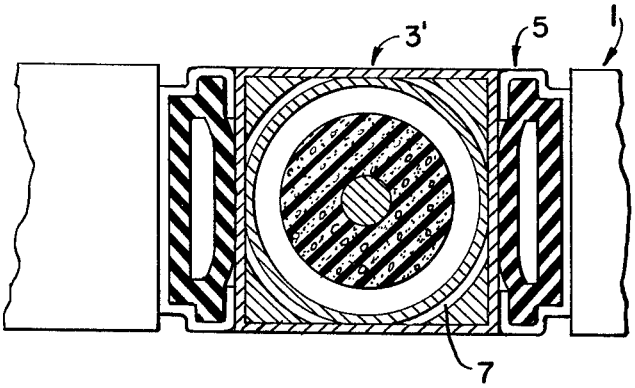
FIG. 9 is a horizontal sectional view taken along the line 9—9 of FIG. 6.
Figure 10:
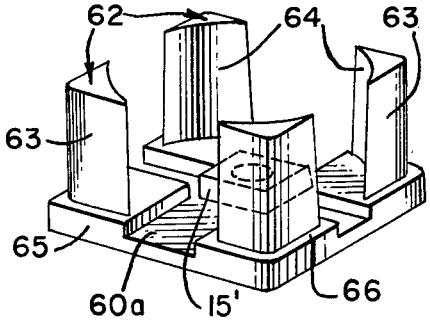
FIG. 10 is a bottom perspective view more clearly illustrating the construction of the top cap element of the connector member as employed with a square sectioned supporting post.

Referring now to the drawings, more particularly FIGS. 3 and 8, the various components common to the two embodiments of the invention may be more readily appreciated. In each instance a panel, generally designated 1, having a body 2, constructed of any suitable material, is adapted to be releasably attached to either a post 3 of circular cross-section or a post 3′ of square configuration and locking means in the form of a cap and plug assembly 4 or 4′ respectively is utilized to rigidly secure the assembled components in the use position. The exact construction of the body 2 of the panels 1 is not critical insofar as the practice of the present invention is concerned, it being necessary only to ensure that a suitable edge channel 5 is provided along the vertical side edges of each panel 1 intended to be joined to a post or standard 3 or 3′. By employing an edge channel construction 5 as shown in the attached drawings, it will be appreciated that any panel 1 so equipped may be alternatively supported upon either a circular sectioned post 3 or a square sectioned post 3′ without any modification of the panels.

Figure 1:
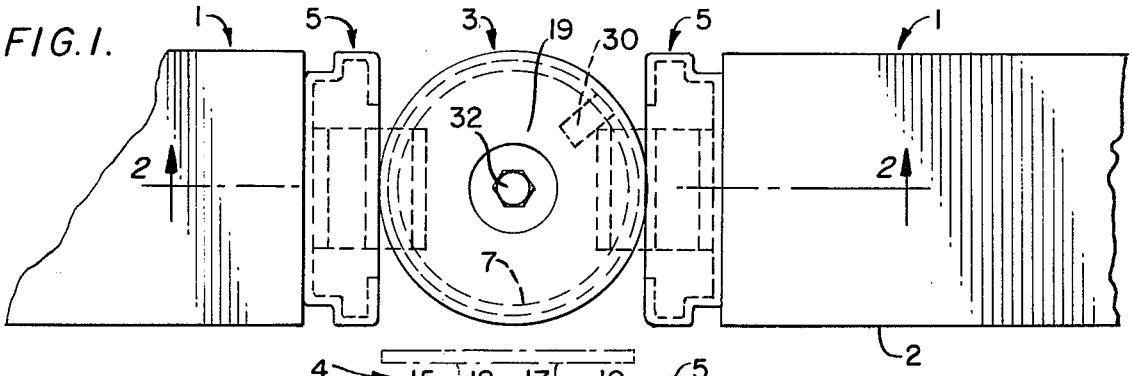
FIG. 1 is a fragmentary top plan view illustrating one form of a portable wall assembly according to the present invention.
Figure 2:
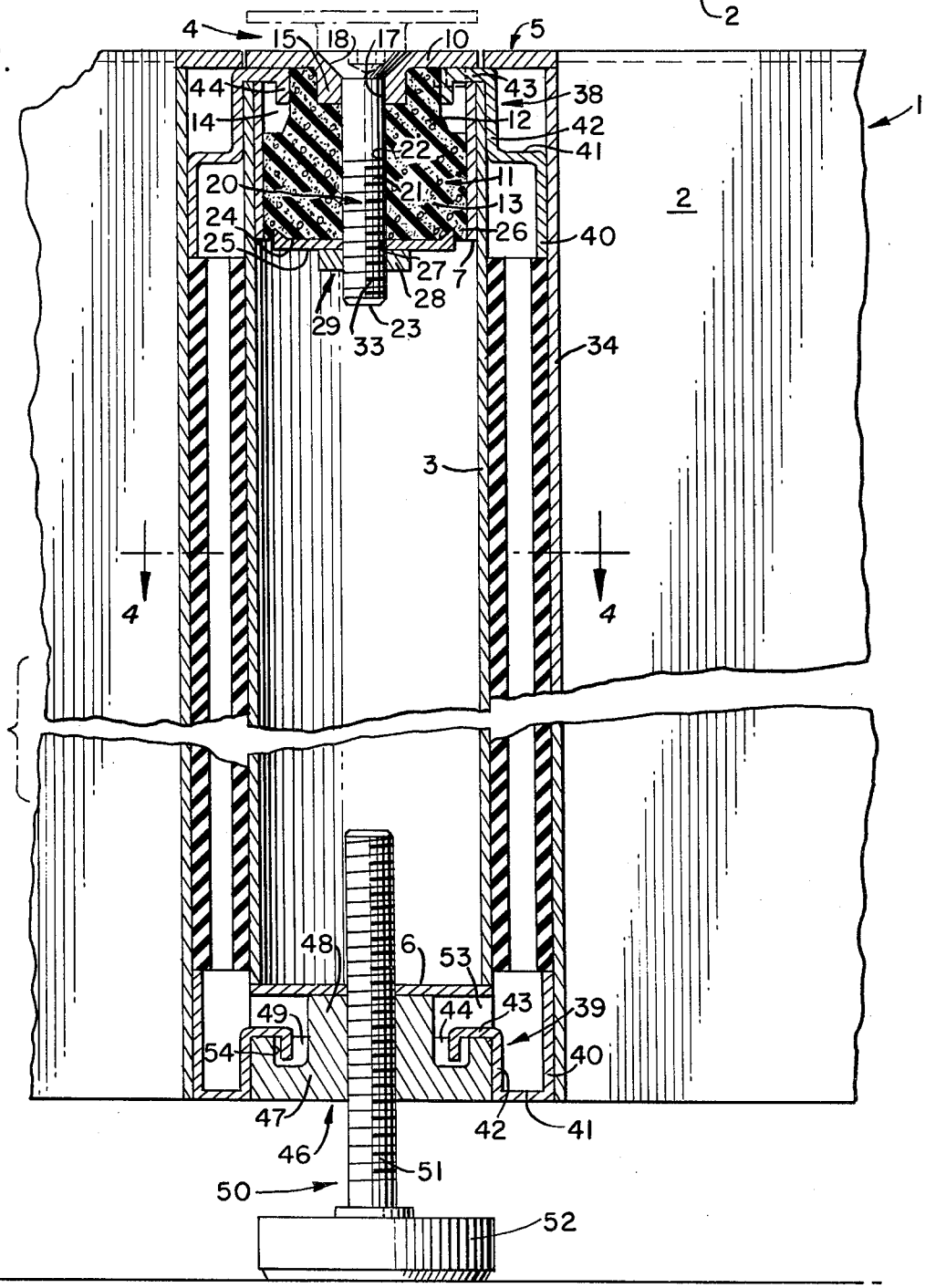
FIG. 2 is a vertical sectional view taken along the line 2—2 of FIG. 1.

The constuction shown in FIGS. 1–4 and relating to the circular sectioned post or standard 3 will be initially described. The circular post 3 is open at the top and closed at the bottom by means of the circular bottom wall 6 as shown in FIG. 2 of the drawing. A circular inner ring 7 is disposed within the upper portion of the post 3 with its top flush with the top edge 8 of the post and this ring 7 is suitably anchored in this permanent location such as by spot welding along its lower edge or by an epoxy adhesive in a fashion which will not mar the outer periphery 3*b* of the post 3 or produce any irregularities adjacent the top edge of the post or within the inner periphery 9 of the ring 7 for reasons which will become apparent hereinafter.

Cooperating with the upper portion of each post 3 is the cap and plug assembly 4 comprising a top cap or a retainer plate 10 connected to an expansible connector plug 11, the latter of which comprises a molded elastomeric substance including a circular upper, smaller diameter portion 12 integral with a lower, larger diameter portion 13. As will be seen most clearly in FIG. 3 of the drawings, the circular top cap 10 cooperates with the circular larger diameter portion 13 and intermediate circular smaller diameter portion 12 to define a peripheral groove 14 therebetween. The top cap 10 includes a centrally disposed depending axial portion 15 extending downwardly from the undersurface 16 of the top cap and preferably provided with a polygonal configuration upon its radial periphery to preclude relative arcuate displacement between the top cap 10 and expansible connector plug 11. As will be seen in FIG. 2 of the drawings, the center of the top cap and its polygonal portion 15 is provided with an axial hole 17 having the upwardly facing countersink 18 therein adapted to provide for flush engagement with the head 19 of the screw 20. Similarly an axial bore 22 is formed through the expansible connector plug 11, through which the screw 20 extends with its distal portion 23 projecting well below the bottom surface 24 of the lower, larger diameter portion 13 of the connector plug 11. It will be understood that the threads formed on the screw shank 21 do not provide any interference fit with the top cap axial portion 15 or the bore 22 of the connector plug 11.

Overlying at least a portion of the bottom surface 24 of the connector plug 11 is the nut plate 25 which is attached thereto by means of a plurality of projections 26 entering into the body of the material of the connector plug 11 in a manner to preclude any relative displacement between the nut plate and the molded composition of the connector plug 11. A central bore 27 formed in the nut plate 25 likewise does not provide any interference fit with the threaded shank 21 of the screw 20. Suitably secured to the lower portion of the nut plate 25, as by spot welding, is the nut 28 with which the threads of the screw 20 at all times engage. Thus it will be seen that the nut plate 25 and nut 28 comprise a unitary combination which is at all times arcuately fixed relative the undersurface 24 of the connector plug 11 and may be referred to as a nut plate assembly 29. The undersurface 16 of the top cap 10 is provided with at least one downwardly extending tab 30, the outermost extent of which is disposed inwardly from the periphery 31 of the top cap and the function of which will be explained hereinafter.

When the cap and plug assembly 4 is removed from a post 3 as shown in FIG. 3 of the drawings, it is considered to be in the released condition, that is, a screw 20 has been manipulated a sufficient amount to ensure that the upper and lower portions 12 and 13 of the expansible connector plug 11 are in a relaxed state. In this condition, all compressive force tending to draw the top cap 10 toward the nut plate assembly 29 has been released so that the elastomeric material of the connector plug 11 assumes its normal diametrical and axial dimensions. At this time the diameter of the lower, larger diameter portion 13 of the connector plug 11 will be understood to define a close sliding fit within the confines of the inner periphery 9 of the post inner ring 7.

Other relative dimensions between the various components of the cap and plug assembly 4 should be understood at this time. The nut plate 25 defines a diameter which is less than that defined by the inner periphery 9 of the ring 7 so that at no time is there any interference between these two members, while on the other hand, the diameter of the circular periphery 31 of the top cap 10 is greater than that of the lower, larger diameter portion 13 of the connector plug 11 when in the relaxed condition as shown in FIG. 3 of the drawings. To facilitate the ready manipulation of the screw 20, a suitable tool engaging opening such as the hexagonal socket 32 is formed in its head 19 and complete withdrawal of the threaded shank 21 of the screw 20 from the cap and plug assembly 4 is precluded by means of a suitable stake 33 formed adjacent the distal portion of the screw 20.

With the above described structure in mind, the operation of the cap and plug assembly 4 when inserted into the inner ring 7 may be readily understood, particularly with reference to FIG. 2 of the drawings. Following insertion of the cap and plug assembly 4 into the post 3, it will follow that when the screw 20 is rotated the captive nut assembly 29 will be drawn upwardly as the undersurface of the screw head 19 journaled with the countersunk surface 18 of the top cap 10 is drawn downwardly. Continued tightening of the screw 20 will transmit the upward displacement of the nut 28 and its attached nut plate 25 as a compressive force in an axial direction upon the material of the connector plug 11 and since the lower, larger diameter portion 13 thereof previously formed a close sliding fit with the inner periphery 9 of the ring 7, it will be seen that only a nominal manipulation of the screw 20 will be required in order to radially expand the large diameter portion 13 of the connector plug 11 into rigid clamping engagement with the inner periphery of the ring 7 until the top cap 10 and connector plug 11 are firmly attached to the upper portion of the post 3.

Turning now to the construction of the panels 1 which are attached to the post 3 by means of the foregoing described mechanism, it will be seen that each vertical side edge of the panels 1 is provided with the edge channel 5 having a vertical height approximately that of the cooperating mounting post 3. Each of the edge channels 5 includes a base wall 34 suitably attached to the lateral edge of the panel 1 and from which extends outwardly a pair of side walls 35—35, each in turn terminating in an inwardly directed flange 36 as will be seen most clearly in FIGS. 1 and 4 of the drawings. The described edge channel components will thus be seen to define a channel cavity 37 from which projects a pair of mounting clips generally designated 38 and 39 adjacent the upper and lower limits of the edge channel respectively. Each clip includes a mounting leg 40 suitably affixed to the base wall 34 of the edge channel and from which projects an intermediate leg 41 having an upwardly directed outer vertical leg extending therefrom substantially in the plane of the flanges 36—36 of the edge channel 5. Projecting horizontally and outwardly from the upper portion of each outer vertical leg 42 is a top arm 43 which terminates in a downwardly directed tongue 44 having inwardly tapered lateral edges 45—45.

The top-most mounting clip 38 cooperates with the cap and plug assembly 4 as will be related hereinafter while the bottom-most mounting clip 39 engages and is retained by a bottom cap 46 which is preferably permanently affixed to the post bottom wall 6. This bottom cap 46 includes a cylindrical main body portion 47 having a diameter equal to that of the outer periphery 3*b* of the mounting post 3, and which is attached to the post bottom wall by means of an axial hub 48 of substantially lesser diameter than the main body portion 47 and the outer periphery of which extends downwardly into the main body portion in order to provide a concentric groove 49 having an upwardly facing opening disposed substantially intermediate the radius of the bottom cap 46 as shown most clearly in FIG. 2 of the drawings.

To elevate the wall assembly above the floor or other supporting surface, a suitable adjustable foot 50 is provided, the foot preferably including a screw 51 threadedly disposed through the center axis of the bottom cap 46 and projecting through the post bottom wall 6 with an appropriate glide 52 secured to its lower portion so that manual rotation of the glide or screw produces variations in the elevation of the bottom cap 46 and thus all other structure associated therewith.

With the above structure in mind, the assembly of the panels 1 to a post 3 may now be readily understood. The cap and plug assembly 4 is positioned within the inner ring 7 at the top of the post 3 with the top surface 13*a* of the lower, larger diameter portion 13 of the connector plug 11 disposed substantially co-planar with the top edge 8 of the post 3 and the cap 10 is rotated if necessary to position the tab 30 away from the side of the post 3 which will be juxtaposed the panel 1 being assembled therewith. The edge channel 5 of the panel 1 being installed is then moved towards the periphery 3*b* of the post and initially the tongue 44 of the lower mounting clip 49 is inserted through the radial clearance 53 formed above the groove 49 of the bottom cap 46 until the outer vertical edge 42 of this bottom clip 39 strikes the outer periphery of the main body portion 47 of the bottom cap 46, at which time the panel may be lowered a small distance until the top arm 43 of this clip rests upon the main body portion of the cap and the tongue 44 is fully disposed within the concentric groove 49. With this disposition the lateral edges 45—45 of the tongue 44 form a close fit with the surface of the outer side wall 54 of the bottom cap groove 49 so that the outer vertical edge 42 of the bottom mounting clip 39 will be understood to be retained juxtaposed the outer periphery of the bottom cap main body portion 47.

Subsequently, or on the other hand concurrently with the above operation, the tongue 44 of the uppermost mounting clip 48 is moved inwardly as the panel 1 is elevated a sufficient distance to permit the bottom of the tongue 44 to clear the top edge 8 of the post 3 and to fully enter the peripheral groove 14 of the connector plug 11 until the vertical leg 42 of the top mounting clip abuts the outer periphery 3 of the mounting post. Quite obviously, during this installation of the top mounting clip 38, the bottom mounting clip 39 is momentarily elevated with the top arm 43 and tongue 44 of the bottom clip being disposed within the radial clearance 53. Next, the panel 1 is lowered concurrently with the cap and plug assembly 4 until the top arm 43 of the upper mounting clip rests upon the top edge 8 of the post 3 and the adjacent top edge of the inner ring 7, after which a tool is inserted into the socket 32 of the screw 20 and the screw rotated to cause upward displacement of the nut plate assembly 29 and the resultant expansive action of the lower, larger diameter portion 13 of the expansible connector plug 11 to rigidly interlock the panel 1 to the mounting post 3. In this assembled relationship the structure will appear as in FIG. 2 of the drawings, wherein it will be seen that the top retainer plate 10 of the cap and plug assembly 4 overlies the top arm 43 of the upper mounting clip and is substantially co-planar with the structure of the panel 1. During the tightening of the cap and plug assembly 4, any rotary displacement of the cap and plug assembly will be precluded after the tab 30 is arcuately displaced and strikes one of the lateral edges 45 of the top mounting clip 38, which action thereafter permits the desired expansion of the connector plug 11 to proceed.

In order to enhance the soundproofing and light-tight conditions between opposite sides of the portable wall assembly, a flexible insert, generally designated 55, comprising any suitable deformable composition, may be disposed within the cavity 37 of the edge channel 5 so that when the panels 1 are connected to the mounting post 3 the front face 56 of the flexible insert will be slightly deformed to provide a mating innerface in the area of the juncture between the panels and mounting post.

The same panels 1 described in connection with the embodiment employing the cylindrical mounting post 3 as illustrated in FIGS. 1 through 4 of the drawings is intended to be releasably attachable to any one of the four sides of the square mounting post 3' as reflected in the embodiment illustrated in FIGS. 5 through 10 of the drawings. The cap and plug assembly 4' of this modification employs the same expansible connector plug 11, but together with a square cap 60 having the square top plate 61, the periphery of which is substantially congruent with the cross-section of the associated mounting post 3'. The construction of the cap 60 will be most readily appreciated from a review of FIG. 10, wherein it will be seen that a leg 62 projects from the undersurface of the top plate 61 adjacent each of the four corners of this plate with each leg including two outer side walls 63—63 bounded on the interior side by an arcuate inner wall 64. The leg side walls 63 are spaced inwardly from the top plate periphery 65 an amount approximating the thickness of the material comprising the square post 3' so that a shoulder 66 is formed adjacent the leg side walls and adapted to engage the top edge 8' of the mounting post. Referring to FIG. 8, it will be understood that the same inner ring 7 as utilized in the cylindrical post 3 is inserted in the top of the square post 3' and cooperates with the cap and plug assembly 4' to anchor this assembly to the top of the post in an identical manner as the cap and plug assembly 4 operates in the first described embodiment. During this operation in the second embodiment, the panel mounting clip 38 is moved toward the selected side of the square post 3' with the depending tongue 44 thereof passing through the passageway 56 defined by the two juxtaposed spaced apart cap legs 62—62 and the cap and plug assembly 4' is subsequently lowered, with the panel 1 until the mounting clip top arm 43 rests upon the post top edge 8'. It will be understood that the cap legs 62 move downwardly in an axial manner and form a substantially mating fit within each of the four corner cavities 67 provided between the inner ring 7 and sides of the square posts 3', thus precluding any arcuate displacement of the square cap 60 during the subsequent tightening of the screw 20 associated therewith. Channels 60*a* formed in the undersurface of the cap 60 between each pair of legs 62 provides clearance for the clip top arm 43 and provide a mating fit therewith, thus serving as alignment means for centering a panel against each post side wall while allowing the shoulder 66 to remain flush with the post top edge 8'.

In this second embodiment the attachment of the bottom mounting clips 39 is most readily achieved by providing a vertically extending rectangular opening 68 through each side wall of the square section post 3' as shown in FIGS. 6 and 7 of the drawings. The lower opening of the post 3' is closed by means of a bottom cap or square plug 69 having vertical side walls 70 forming a close fit within the interior of the square post and including top edges 71 intended to be disposed co-planar with the bottom edge 72 of each opening 68 when in position as shown in FIG. 6 of the drawing. In this manner, by providing the side walls 70 of the bottom cap 69 with a sufficient thickness it will follow that the combined thickness of these side walls and the material of the square sectioned post 3' will serve to fill up the space between the depending tongue 44 and outer vertical leg 42 of the bottom mounting clip 39 to enhance a snug fit at the lower portion of the panels 1. An appropriate nut 73 is suitably attached to the bottom cap 69 for the reception of the foot assembly 50, which is intended to be operated in the same manner as described in connection with the first related embodiment.

Figure 11:
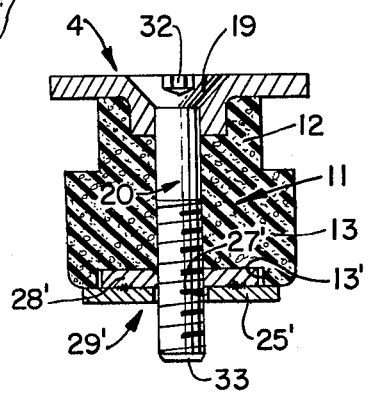
FIG. 11 is a side elevation view, partly in section, of a modified nut plate assembly associated with the cap and plug assembly.
Figure 4:
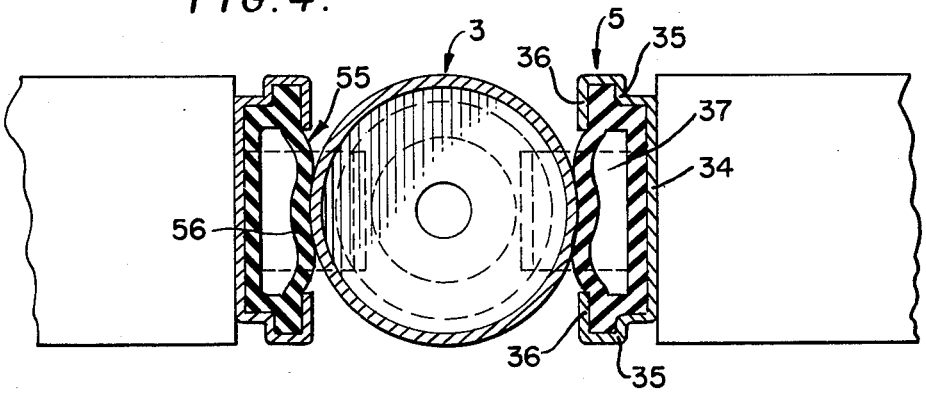
FIG. 4 is a fragmentary horizontal sectional view taken along the line 4—4 of FIG. 2.

The modified nut plate assembly 29' shown in FIG. 11 of the drawings may be alternatively employed with the cap and plug assembly 4 as used with either the square or circularly sectioned posts and obviates the requirement for providing projections 26 on the nut plate 25. In the modification of the figure the assembly 29' will be seen to be reversed, with the nut 28' above the nut plate 25' and suitably secured thereto as by spot welding. The assembly 29' is precluded from rotary displacement during actuation of the screw 20 due to the recess 13' molded in the bottom of the connector plug 11 and which forms a close fit with the nut 28'.

We claim:

1. A portable wall assembly including, a panel element having a vertical side edge, an upright post disposed adjacent said panel edge for supporting same, vertically spaced apart mounting means carried by said panel and projecting from said side edge for support by said post, said mounting means including a top clip overlying the top of said post and having a depending tongue inserted into the upper portion of said post, a cap and plug assembly securing said top clip tongue against vertical and lateral displacement relative to said post, said cap and plug assembly including a top cap plate affixed to a connector plug, said plug of elastomeric material and disposed within said post and including an upper smaller diameter portion disposed above a lower larger diameter portion, said cap plate overlying said top clip tongue when inserted into said post with said tongue disposed above said lower larger diameter portion, and means operable from outside said cap and plug assembly to vertically compress and laterally expand said elastomeric connector plug to retain said cap plate in locking engagement atop said panel top clip as said lower larger diameter portion of said plug is expanded to engage the interior of said post.

2. A portable wall assembly according to claim 1 wherein, said post comprises a cylindrical tube and said cap plate and connector plug are cylindrical.

3. A portable wall assembly according to claim 2 including, an inner ring fixed within said tube post adjacent the top thereof and the diameter of said cap plate is greater than the inner diameter of said ring.

4. A portable wall assembly according to claim 1 wherein, said post comprises a square tube and said cap plate is of square configuration.

5. A portable wall assembly according to claim 4 wherein, said connector plug is cylindrical, an inner cylindrical ring fixed within said square post adjacent the top thereof and the length of any one side of said cap plate is greater than the diameter of said ring.

6. A portable wall assembly according to claim 5 wherein, said ring defines with each corner of said square post an irregularly configured cavity, and said square cap plate includes a plurality of depending legs mating within said cavities to maintain the angular alignment of said cap plate with said square post.

7. A portable wall assembly according to claim 1 wherein, said mounting means includes a bottom clip having a laterally projecting tongue, a bottom cap attached to the lower portion of said post and including means engageable by said bottom clip to support said panel.

8. A portable wall assembly according to claim 1 wherein, said operable means includes a screw disposed through said cap plate and plug and a nut engaging said screw beneath said plug, a nut plate anchored to the bottom of said plug and said nut is fixed to said nut plate.

9. A portable wall assembly according to claim 8 wherein, said nut plate includes projections embedded within the bottom of said plug to preclude rotary displacement therebetween and said nut is disposed beneath said nut plate.

10. A portable wall assembly according to claim 8 wherein, said plug is provided with a bottom recess with said nut disposed therein and said nut plate is disposed beneath said nut.

11. A portable wall assembly according to claim 1 wherein, said operable means includes a screw disposed through said cap plate and plug and a nut engaging said screw beneath said plug.

12. A portable wall assembly according to claim 1 wherein, said cap includes a planar top and a depending axial portion of substantially lesser radial extent than said planar top, and a tab disposed beneath said planar top and projecting radially from said axial portion.

* * * * *